US008025126B1

(12) United States Patent
Lefavor

(10) Patent No.: US 8,025,126 B1
(45) Date of Patent: Sep. 27, 2011

(54) ROOF BRACKET

(76) Inventor: William J. Lefavor, Raleigh, NC (US)

( * ) Notice: Subject to any disclaimer, the term of this patent is extended or adjusted under 35 U.S.C. 154(b) by 309 days.

(21) Appl. No.: 12/420,155

(22) Filed: Apr. 8, 2009

(51) Int. Cl.
*E04G 3/26* (2006.01)
*E04G 3/34* (2006.01)

(52) U.S. Cl. ..... 182/45; 248/237

(58) Field of Classification Search ..... 182/45; 248/235–238, 229.2, 229.25; 52/24, 26
See application file for complete search history.

(56) References Cited

U.S. PATENT DOCUMENTS 298,463 A * 5/1884 Guedle ..... 182/45
510,194 A * 12/1893 Sellers ..... 248/236
590,872 A * 9/1897 Allen ..... 182/45
713,061 A 11/1902 Clum
1,143,678 A * 6/1915 Winans ..... 248/238
5,249,397 A * 10/1993 Monaco ..... 52/126.1
5,558,306 A * 9/1996 Binford et al. ..... 248/148
5,913,782 A * 6/1999 Monaco et al. ..... 52/126.1
6,543,733 B1 * 4/2003 Pennington ..... 248/149
7,036,629 B2 5/2006 Nicolaysen ..... 182/45
7,240,770 B2 7/2007 Mullins et al. ..... 182/3

* cited by examiner

*Primary Examiner* — Alvin Chin Shue
*Assistant Examiner* — Jaime F Cardenas-Garcia

(57) ABSTRACT

A roof bracket for easy attachment to various types of roofs for construction, maintenance and repair purposes. The roof bracket can be used singularly to hold materials, tools or for attachment of a workman's lanyard or can be used in multiples to form a set of steps or for a scaffolding assembly. The roof bracket is formed of metal and is easily assembled, installed and removed as required for shingled and metal standing seam roofs.

16 Claims, 9 Drawing Sheets

ROOF BRACKET

FIELD OF THE INVENTION

The invention herein pertains to roof brackets, in particular roof brackets utilized in the roofing industry which allow for installation, maintenance and construction on various roof styles and which provides a safe anchor for workmen.

DESCRIPTION OF THE PRIOR ART AND OBJECTIVES OF THE INVENTION

Over the years various types of roof brackets and other means have been utilized by workmen for safety and assistance during roof installation, inspection, maintenance and otherwise. U.S. Pat. No. 713,061 provides a clamp for use on a roof for scaffolding. U.S. Pat. No. 7,036,629 provides a bracket for use on a standing seam roof which also can be used for supporting scaffolding planks. The roof anchor demonstrated in U.S. Pat. No. 7,240,770 utilizes a pair of blocks which are placed side by side for engaging a roof seam and a bracket for engaging the blocks which includes a loop for connection to a workman's lanyard.

In the roofing industry workers encounter various types of roofs such as asphalt shingle, flat metal, standing metal seam and other types. Problems are often encountered as workmen move from building roof to building roof of different types, each requiring different brackets for scaffolding, lanyard anchoring, safety line attachment, and for securing supplies and equipment. Thus there exists the need for a more universal roof bracket which will be useful on the majority of different types of roofs for different uses and which reduces the necessity of purchasing and storing many different roof bracket types.

As a result of the problems, difficulties and limitations of current roof brackets the present invention was conceived and one of its objectives is to provide a relatively low cost, lightweight roof bracket which can be used on either standing metal seam roofs or shingled roofs that will provide equal security and simplicity of attachment.

It is another objective of the present invention to provide a roof bracket which is relatively inexpensive to manufacture and sell and which can be easily assembled, installed and removed by inexperienced workmen.

It is still another objective of the present invention to provide a roof bracket which includes a pair of threaded tension members for tightening against a standing metal roof seam to secure the bracket in place and which can be easily removed after use.

It is still yet another objective of the present invention to provide a roof bracket with non-marking, anti-skid plates to assist in securement of the bracket to a standing metal roof seam and which will prevent any damage of the roof bracket to the metal roof.

It is yet another objective of the present invention to provide a roof bracket which can be easily fastened and secured in place to a shingled roof using a security plate which will not damage the shingles or roof deck.

It is still a further objective of the present invention to provide a roof bracket which can be used by a workman to secure a lanyard or a safety tie-off for a ladder as required.

It is yet a further objective of the present invention to provide a roof bracket which can be used to provide steps for workmen to insure secure footing while working on a roof.

It is also a further objective of the present invention to provide a roof bracket which can be used in the assembly of scaffolding required when working on various roof types.

Various other objectives and advantages of the present invention will become apparent to those skilled in the art as a more detailed description is set forth below.

SUMMARY OF THE INVENTION

The aforesaid and other objectives are realized by providing a metal roof bracket for use on a shingled or standing metal seam roof having a base which includes a pair of parallel C-shaped legs. The base is affixed to an L-shaped top which includes a vertical section and a horizontal section having a forty-five degree (45°) brace centrally located therebetween. A pair of removable security plates can be affixed to the legs for use on shingled roofs which extend forwardly, from the horizontal top section beyond the vertical top section. The security plates each define a pair of apertures for receiving bolts or the like for attachment to the legs of the roof bracket. A plurality of apertures are provided on the extended or forward end of the security plates through which nails or other fasteners can be placed to secure the roof bracket to the deck of a shingled roof. The bracket horizontal top section includes a pair of slots which receive bolts for attachment of the top to the base. Wing nuts are utilized for adjustably maintaining the top securely on the base and for adjustment of the width between the legs as needed. The bracket vertical top section includes a pair of holes which allow for a wooden platform to be bolted thereto for example when the roof bracket is used to form scaffolding.

When used on a standing metal seam roof the base of the bracket is positioned with a roof seam between the legs whereby a pair of threaded tensioners passing through a pair of threaded ports in one of the legs are tightenable against the standing seam to secure the bracket thereto while maintaining the seam between the legs. Anti-skid disks are provided on the ends of the pair of threaded tensioners and an anti-skid layer is provided on the inside of the opposing leg to prevent damage to the standing seam when the pair of threaded tensioners are tightened against the metal seam. A pair of inverted L-shaped threaded tensioners which pass through a pair of threaded ports in each leg are utilized to further insure a rigid, secure attachment between the roof bracket and the metal seam. The horizontal section of the top is bolted to the C-shaped legs of the base and allows adjustability of the top for acceptance of various height/width metal seams. A pair of removable non-marking, anti-skid plates are utilized on the bottom of the legs in place of the security plates when using the roof bracket on a standing metal seamed roof to prevent damage or marring to the roof.

The roof bracket can be utilized in various ways such as to secure a lanyard or a ladder safety tie-off line and can also be used for gripping or to form a series of steps for workmen as needed. When used as for scaffolding two or more brackets are aligned and fitted with a wooden platform. The platform is affixed to each bracket with bolts placed through mounting holes in the vertical top section.

DETAILED DESCRIPTION OF THE PREFERRED EMBODIMENT AND OPERATION OF THE INVENTION

Figure 1:
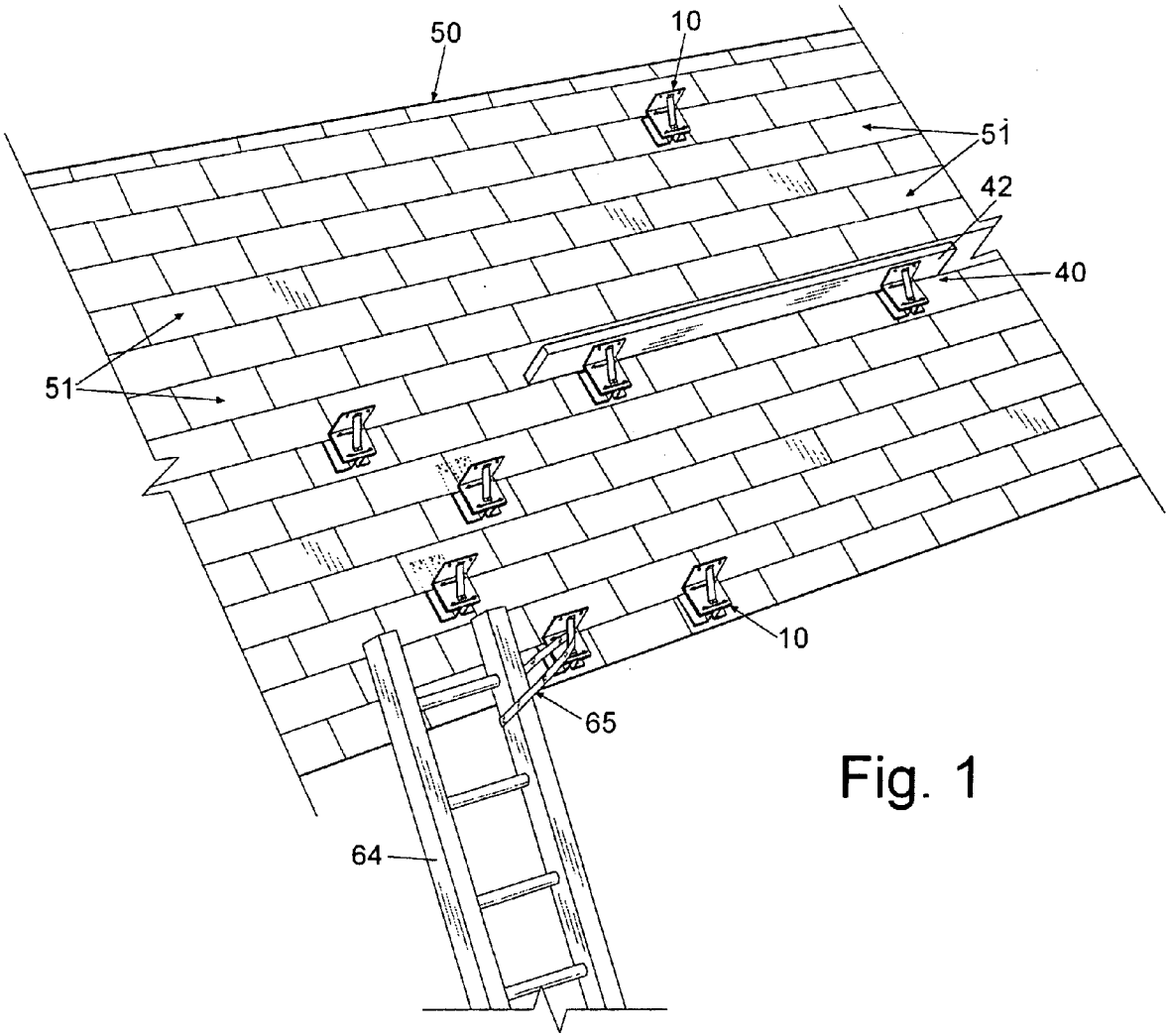
FIG. 1 demonstrates multiple roof brackets of the invention on a typical shingled roof in various positions.
Figure 2:
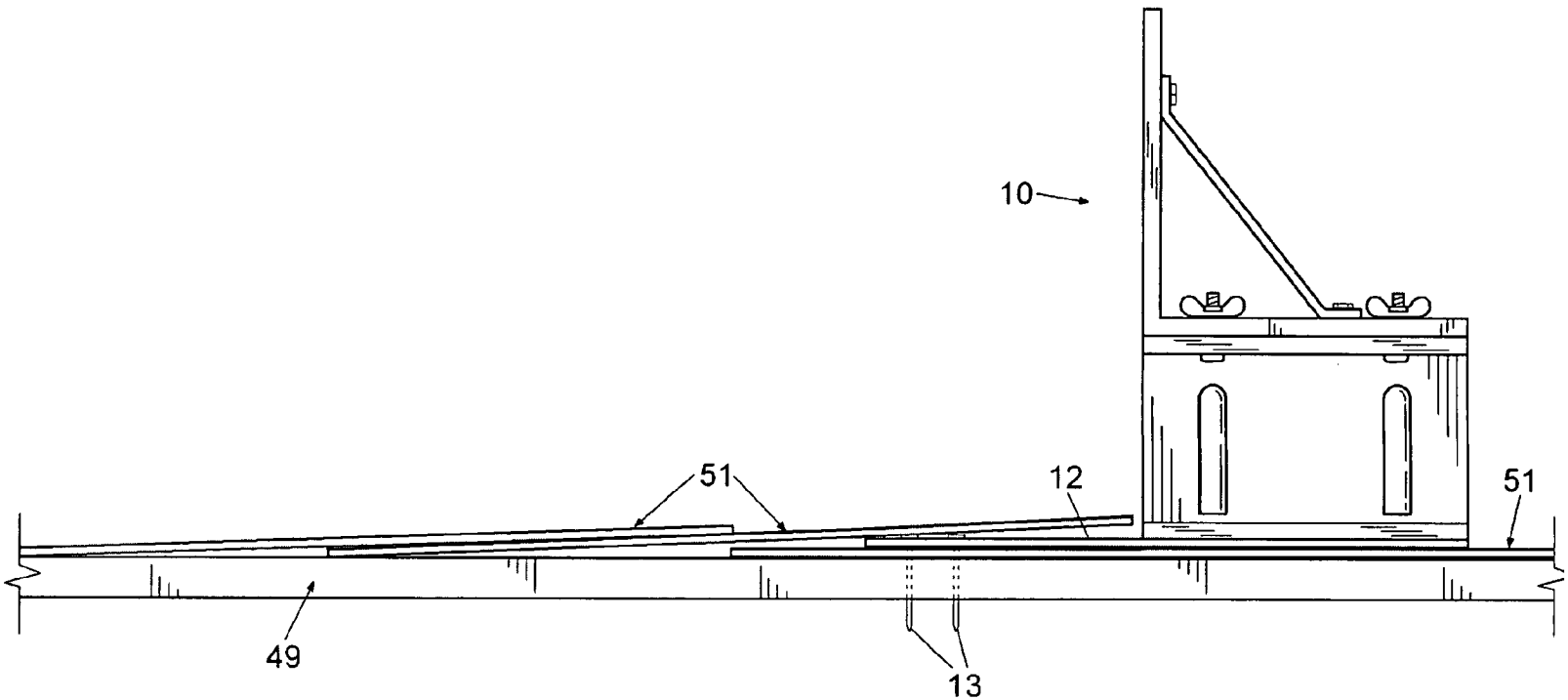
FIG. 2 shows a right side view of a roof bracket as affixed to the roof as shown in FIG. 1.
Figure 3:
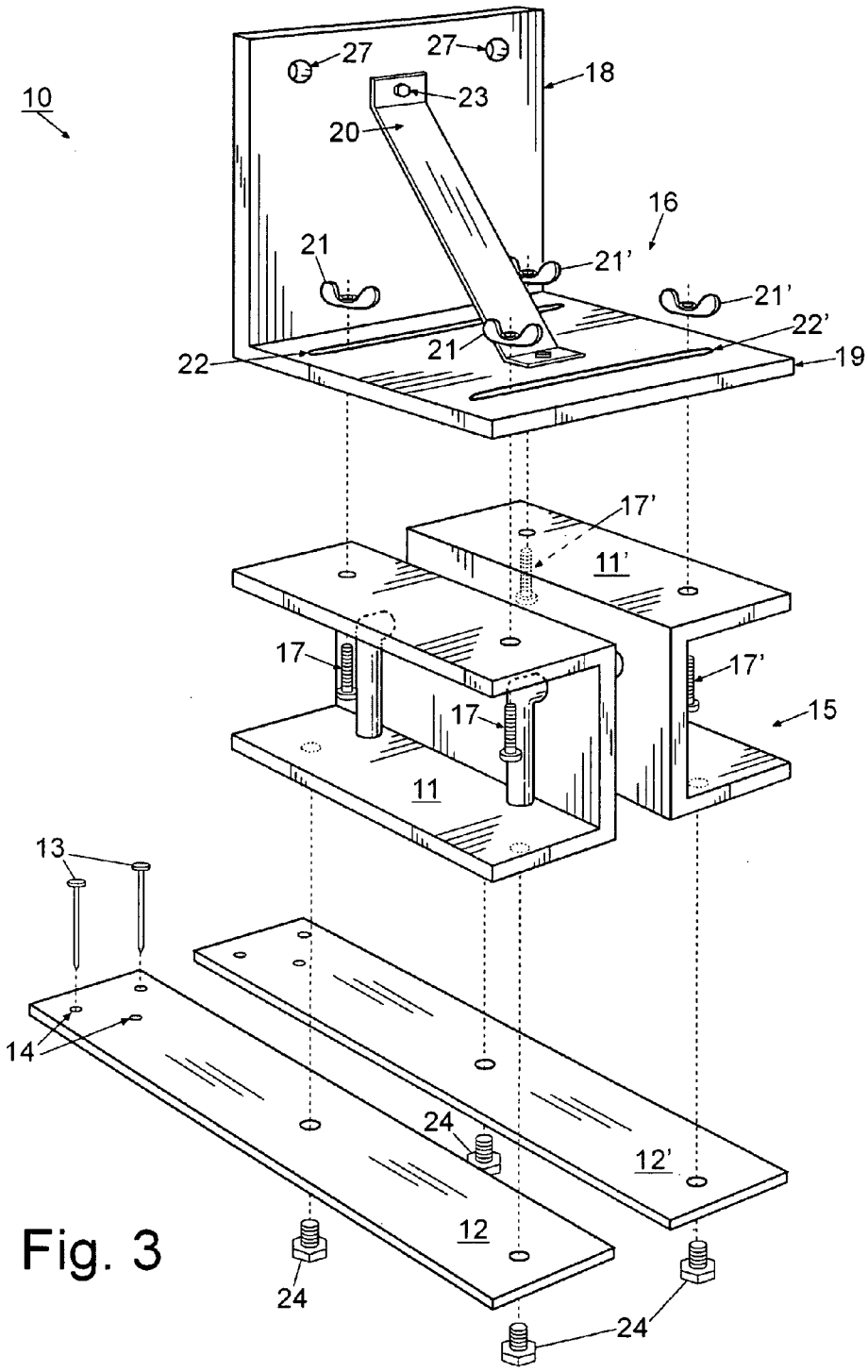
FIG. 3 illustrates a perspective exploded view of the roof bracket as seen in FIG. 2 removed from the roof.

For a better understanding of the invention and its method of use, turning now to the drawings, FIG. 1 depicts multiple preferred roof brackets 10 made of metal or other suitable materials positioned on conventional shingled roof 50 proximate shingles 51. Bracket 10 is shown removed from roof 50 in various views throughout FIGS. 3-8 and includes base 15 and top 16 as seen in FIG. 3. Base 15 includes parallel, spaced apart C-shaped legs 11, 11' with security plates 12, 12', as used for attaching roof brackets 10 to shingled roofs as demonstrated in FIG. 1 whereby two roof brackets 10 are shown with security plates 12, 12' seen in dotted line fashion to demonstrate placement thereof. Security plates 12, 12' are formed preferably from metal though other materials could be used and are removably attached respectively to legs 11, 11' such as by bolts 24 (FIGS. 3 and 8) which are inset thus creating a flat, planar bottom for roof bracket 10 as demonstrated in FIGS. 2, 5 and 6. Legs 11, 11' each include a pair of threaded bores (not shown) for receiving and securing bolts 24 therein to maintain security plates 12, 12' thereon although helicoil inserts, jack-nuts, or other standard threaded inserts (not seen) could also be used for affixing security plates 12, 12' as appropriate.

Figure 5:
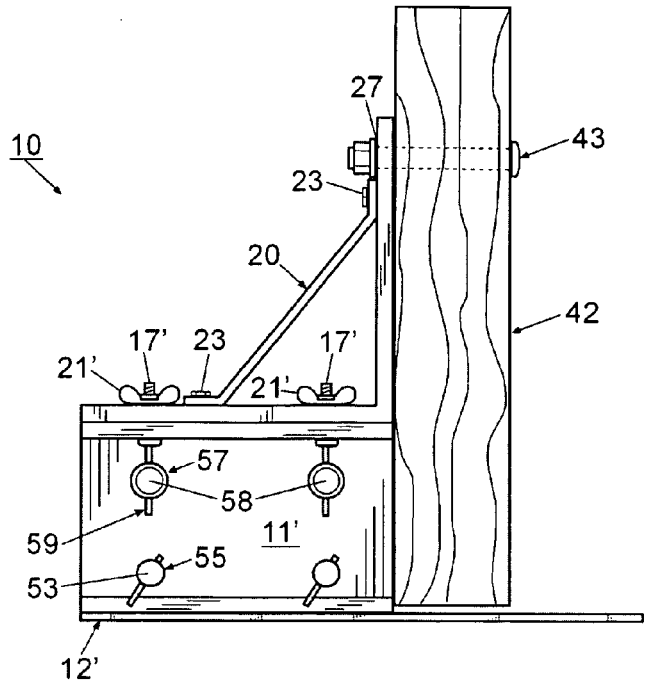
FIG. 5 shows a left side view of the roof bracket of FIG. 4 with a wooden platform or board attached.
Figure 6:
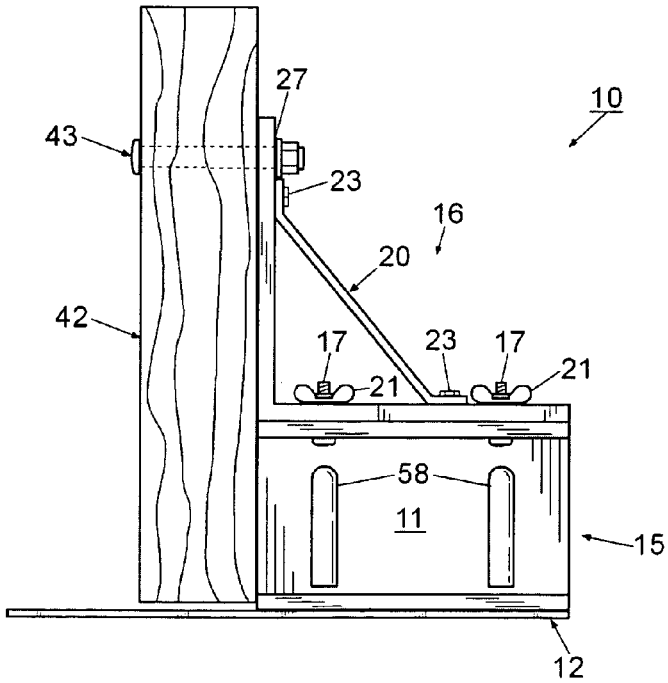
FIG. 6 pictures a right side view of the roof bracket of FIG. 5.
Figure 7:
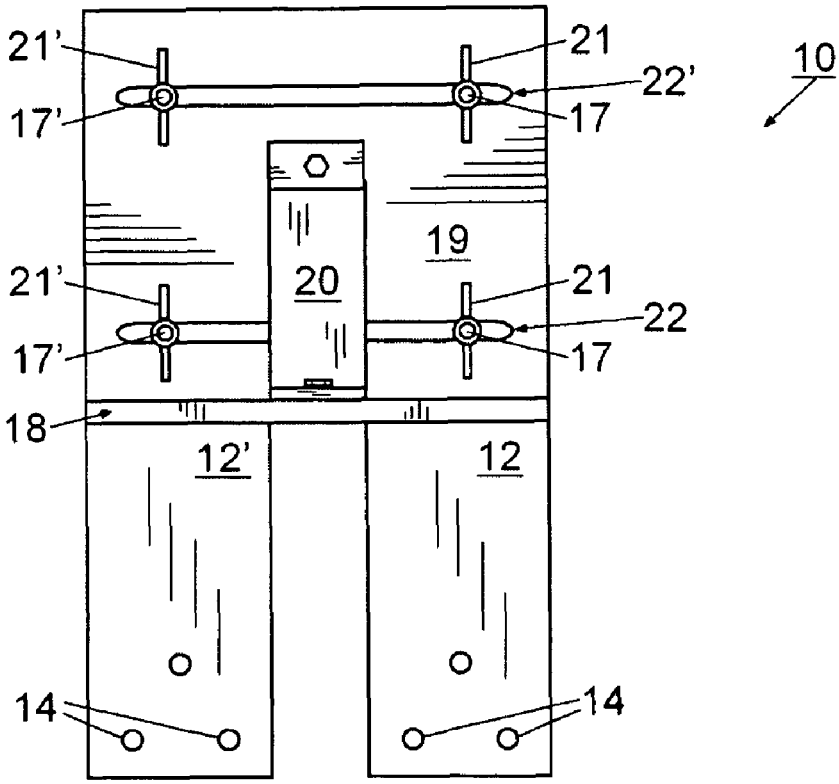
FIG. 7 features a top view of the roof bracket.

Top 16 is L-shaped and connected to legs 11, 11' using conventional wing nuts 21, 21' and bolts 17, 17' as seen in FIGS. 3 and 7. L-shaped top 16 includes vertical section 18, horizontal section 19 and brace 20 affixed therebetween, seen also in FIGS. 4, 5 and 6. Horizontal top section 19 includes a pair of slots 22, 22' each of which receive respectively, one each of bolts 17, 17' for attachment of top 16 to base 15. Bolts 17, 17' and wing nuts 21, 21' are utilized for adjustably maintaining top 16 securely with base 15 and for slideably adjusting the width between legs 11, 11' as needed. Brace 20 is preferably centrally affixed, angularly at about forty-five degrees (45°) between vertical section 18 which is integrally formed with horizontal section 19 of top 16. Vertical section 18 and horizontal section 19 include threaded bores (not shown) or inserts for receiving and securing bolts 23 therein for attachment of brace 20 (FIG. 6). Brace 20 assists in the rigidity of top 16 and also allows for easy, convenient hand gripping or attachment for a lanyard or other line, tools or supplies.

Figure 8:
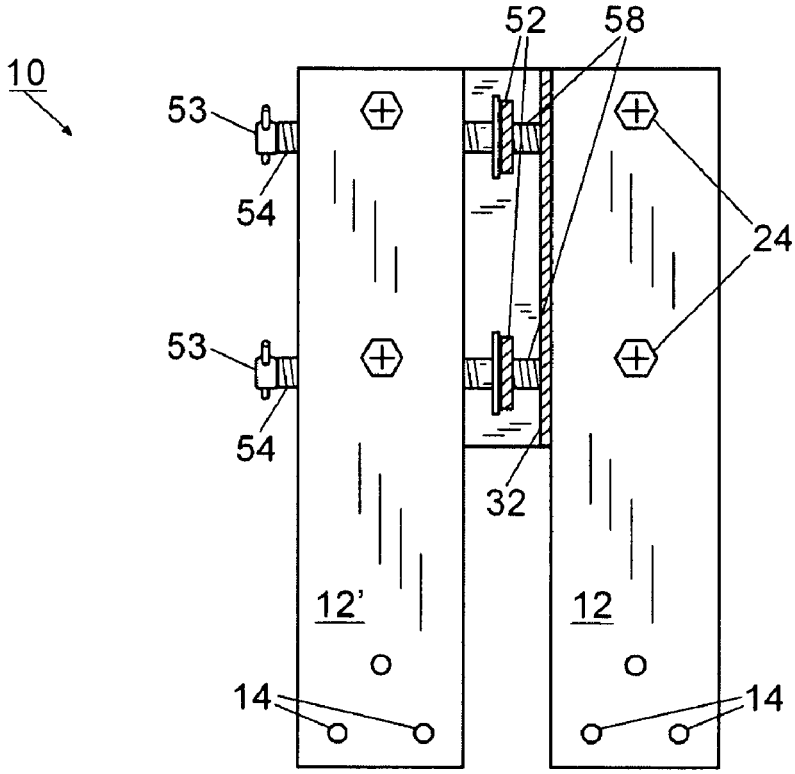
FIG. 8 illustrates a bottom view of the roof bracket seen in FIG. 4.

In the method of use on typical shingled roof 50, roof bracket 10 as shown in FIG. 1 is attached to roof 50 by lifting shingles 51 and placing security plates 12, 12' which are affixed to bracket 10 thereunder, using standard mechanical fasteners 13 (FIG. 2) which may be nails, screws, tacks or the like. Fasteners 13 are inserted through security plate apertures 14 and are then driven into plywood roof deck 49. During placement of bracket 10, shingle 51 is first carefully lifted from roof deck 49 to prevent damage thereto and security plates 12, 12' affixed to bracket 10 are positioned thereunder whereby the edge of shingle 51 will be proximate legs 11, 11' as in FIG. 2. Fasteners 13 are then driven with a hammer or other tool to tightly affix security plates 12, 12' of bracket 10 to roof deck 49 of roof 50. While only two fasteners 13 are shown in FIG. 2, it would be understood that additional fasteners 13 may be used to engage all three (3) apertures 14 provided respectively in each of security plates 12, 12' as shown in FIGS. 7 and 8 in order to secure roof bracket 10 to roof 50 during use. Once the roofing job is complete, the workmen can simply lift shingles 51, remove fasteners 13 from security plates 12, 12', remove roof bracket 10 and return shingles 51 to their original position on roof 50 undamaged.

Figure 9:
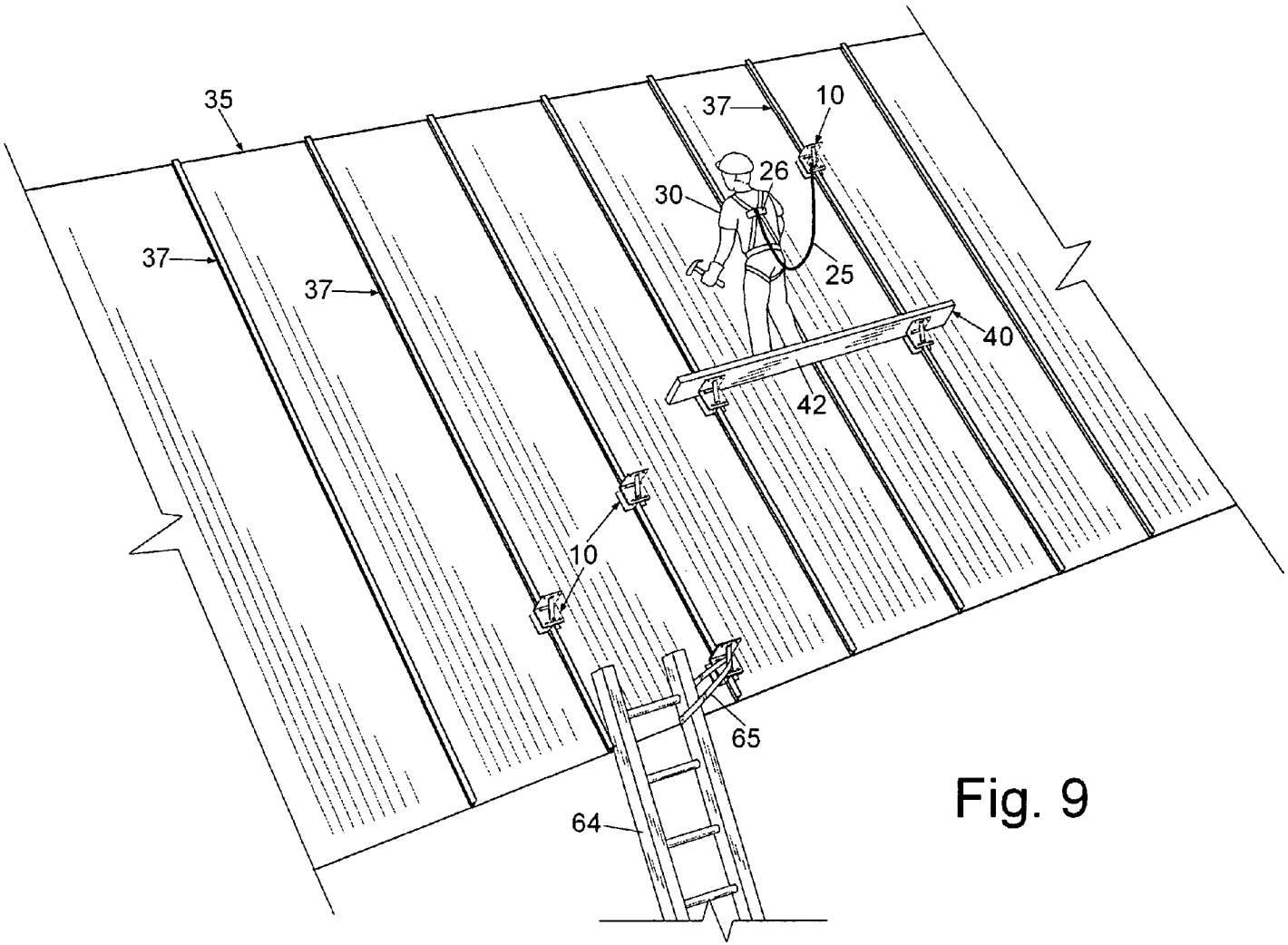
FIG. 9 demonstrates multiple roof brackets on a typical standing metal seamed roof in various positions including a scaffolding assembly using two roof brackets and a platform.

As further shown on shingled roof 50 in FIG. 1, roof bracket 10 can be used singularly, or in multiples such as for forming scaffolding such as scaffolding 40 also seen affixed to standing metal seamed roof 35 in FIG. 9. Roof bracket 10 is lightweight, versatile, preferably formed from aluminum and can be utilized for attachment to a safety line or lanyard 25 as shown in FIG. 9. Here safety belt 26 of workman 30 is attached by lanyard 25 to roof bracket 10, but can also be used for maintaining supplies or tools (not shown) on the roof as necessary. Seen also in FIGS. 1 and 9, roof bracket 10 can be used singularly to secure ladder 64 by safety tie-down 65 or used in multiples and aligned in step fashion to form a set of "steps" or stepping platforms which may be necessary to provide workmen access to scaffolding 40.

In FIG. 1 scaffolding 40 is affixed to shingled roof 50 by a pair of roof brackets 10 utilizing removable security plates 12, 12'. Scaffolding 40 in FIG. 9 is affixed to standing metal seamed roof 35 by a pair of roof brackets 10 utilizing removable non-marking, anti-skid plates 61, 61' which like security plates 12, 12' can be easily installed or removed as necessary. Anti-skid plates 61, 61' (FIG. 10) are formed from rubber, leather or resilient synthetic materials and each includes a pair of bores (not shown) for receiving bolts (such as bolts 24) for attachment to legs 11, 11' to provide a flat, planar bottom to roof brackets 10. Anti-skid plates 61, 61' are non-marking and prevent damage to standing metal seamed roof 35 and provide slip resistance for roof brackets 10 when utilized on a metal roof where it would not be permissible to create holes as in shingled roofs. As would be understood, security plates 12, 12' would be removed and replaced on brackets 10 by anti-skid plates 61, 61' as needed, depending on the type of roof and job to be performed.

Figure 4:
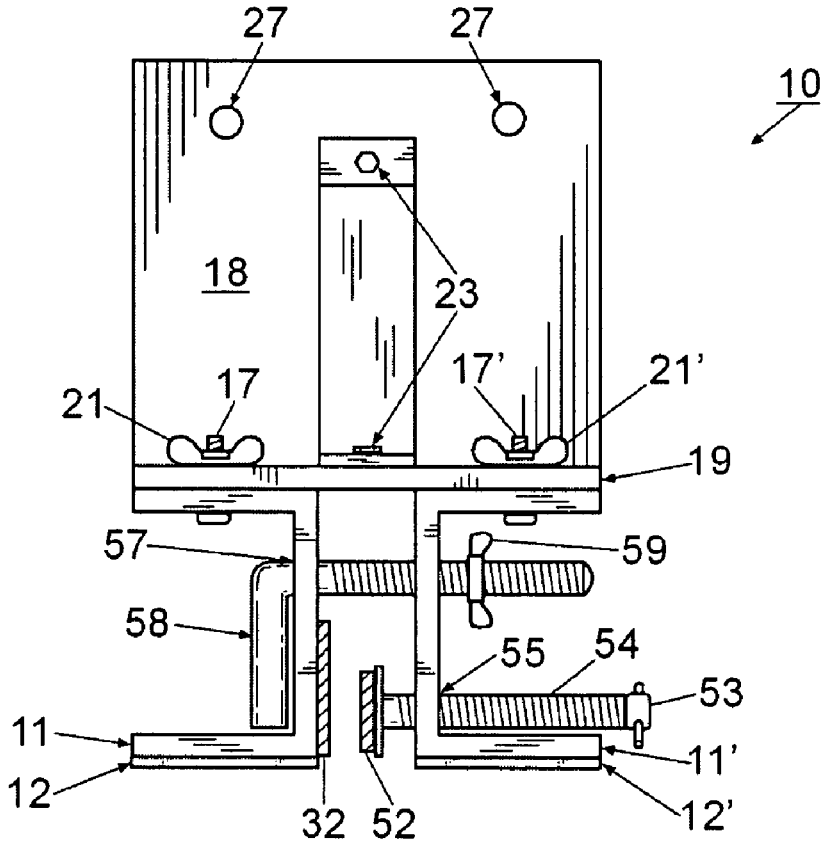
FIG. 4 depicts a rear view of the roof bracket.

When roof bracket 10 is used in a scaffolding mode, as shown for example in FIG. 9, preferably wooden platform 42 is affixed to vertical section 18 of top 16 such as by machine bolts 43 (FIGS. 5 and 6) placed through mounting holes 27 (FIG. 4). Platform 42 may consist of a conventional wooden two by six (2"×6") of suitable length or other suitable lumber as generally used in construction. Vertical section 18 may have a friction producing or "roughened" outer face (not shown) to prevent platform foot slippage.

Figure 10:
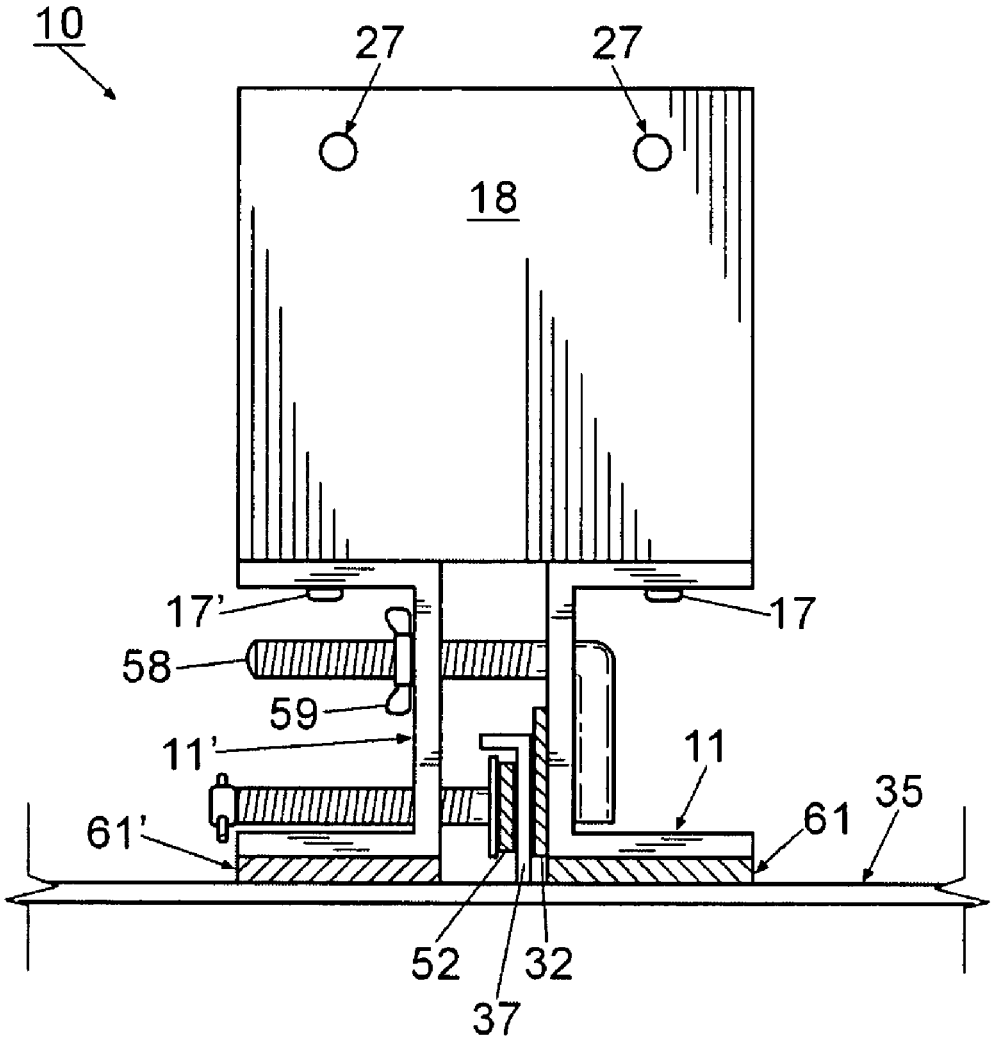
FIG. 10 depicts a schematic front view of a single roof bracket as seen in FIG. 9 attached to a single standing metal roof seam.

Scaffolding 40 is shown in FIG. 9 affixed to standing metal seamed roof 35 having raised seams 37. When affixing bracket 10 to metal seamed roof 35, raised seam 37 is positioned between parallel roof bracket legs 11, 11' of base 15 as seen in FIG. 10. Leg 11' includes two horizontally aligned, spaced threaded ports 55 (FIGS. 4 and 5) each having threaded tensioning members 54 with tensioning grips 53 (FIG. 5) for tightening against metal seam 37 to anchor roof bracket 10 on standing metal seamed roof 35. Tensioning members 54 each include thin, resilient non-marking, anti-skid disk 52. Leg 11 includes thin removable non-marking, anti-skid layer 32 positioned on the inside, in opposing relation to anti-skid disks 52 (FIG. 4) to prevent any damage or marring to seam 37 when tightening tensioning members 54.

Legs 11, 11' each include two horizontally aligned spaced apart threaded ports 57 having threaded L-shaped members 58 positioned therein with wing nuts 59 for tightening purposes as seen in FIGS. 4, 5, 6 and 10. On leg 11', the pair of threaded ports 57 are positioned above and in vertical alignment with ports 55. L-shaped members 58 each include a threaded horizontal portion and a non-threaded vertical portion (FIG. 10). The threaded horizontal portions of L-shaped members 58 are inserted through ports 57 on legs 11, 11' whereby the vertical portions of L-shaped members 58 rest against leg 11 (FIG. 6) for additional stability. Wing nuts 59 are then tightened on the threaded horizontal portions of L-shaped members 58 to secure and maintain roof bracket 10 on seam 37 as seen in FIG. 10. In use, as tensioning members 54 are tightened against seam 37 proximate leg 11, on the opposing side the vertical portion of L-shaped members 58 are likewise tightened against leg 11 and provide for equal pressure in maintaining roof bracket 10 against seam 37.

As would be understood, seam 37 is tightly and securely engaged between legs 11, 11' by tensioning members 54 and L-shaped members 58 applying pressure thereto. Tensioning members 54 and L-shaped members 58 can be hand tightened manually or with a conventional wrench or similar tool. Once brackets 10 are affixed to the selected seams 37, platform 42 can then be affixed as hereinbefore described. When roof scaffolding 40 is so placed, a workman such as workman 30 can then safely walk therealong. To remove scaffolding 40, platform 42 is first removed by extracting bolts 43. Thereafter tensioning grips 53 and wing nuts 59 are loosened respectively from tensioning members 54 and L-shaped members 58 whereby bracket 10 can then be extracted from metal seam 37.

The illustrations and examples provided herein are for explanatory purposes and are not intended to limit the scope of the appended claims.

I claim:

1. A bracket for attachment to a roof comprising:

a base, an L-shaped top, said base comprising a first leg, said base attached to said top, said top comprising a horizontal section and a vertical section, said first leg extending along said horizontal section therebelow, said horizontal section joined to said vertical section, and a brace, said brace centrally positioned between said horizontal section and said vertical section above said horizontal section, said first leg adjustably movable along said horizontal section;

wherein said base further comprises an opposing second leg, said second leg attached to said to and spaced from said first leg, said horizontal section defining a slot, a bolt, said bolt positioned in said slot for attaching said second leg to said horizontal section and for adjusting the space between said first leg and said second leg; and, further comprising a tensioning member, said first leg defining a port, said tensioning member positioned within said port for tightening against a roof seam.

2. The bracket of claim 1 wherein said first leg and said second leg are C-shaped.

3. The bracket of claim 1 wherein said first leg and said second leg are mounted in parallel below said top.

4. The bracket of claim 1 wherein said first leg defines a threaded port.

5. The bracket of claim 4 further comprises a threaded member, said threaded member positioned in said threaded port.

6. The bracket of claim 1 wherein said vertical section defines a mounting hole.

7. Roof scaffolding comprising:

a first bracket, said first bracket comprising:

a base, an L-shaped top, said base comprising a first leg, said base attached to said top, said top comprising a horizontal section and a vertical section, said first leg extending along said horizontal section said horizontal section joined to said vertical section, a brace, said brace positioned between said horizontal section and said vertical section above said horizontal section, said first leg adjustably movable along said horizontal section;

wherein said base further comprises an opposing second leg, said second leg attached to said top and spaced from said first leg, said horizontal section defining a slot, a bolt, said bolt positioned in said slot for attaching said second leg to said horizontal section and for adjusting the space between said first leg and said second leg; and, further comprising a tensioning member, said first leg defining a port, said tensioning member positioned within said port for tightening against a roof seam; and a platform, said platform affixed to said first bracket.

8. Roof scaffolding as claimed in claim 7 wherein said platform is affixed to said vertical section.

9. Roof scaffolding as claimed in claim 7 further comprising a second bracket, said second bracket affixed to said platform.

10. The bracket of claim 1 further comprising an anti-skid disk, said anti-skid disk affixed to said tensioning member.

11. The bracket of claim 1 further comprising a resilient anti-skid plate, said anti-skid plate affixed to said first leg.

12. Roof scaffolding as claimed in claim 7 further comprising a threaded member, said first leg defining a port, said threaded member contained within said port.

13. Roof scaffolding as claimed in claim 12 further comprising a wing nut, said wing nut positioned on said threaded member.

14. Roof scaffolding as claimed in claim 12 wherein said threaded member is L-shaped.

15. Roof scaffolding as claimed in claim 7 wherein said first bracket further comprises an L-shaped threaded member, said first leg defining a port, said L-shaped threaded member contained within said port, a wing nut, said wing nut positioned on said threaded member.

16. Roof scaffolding as claimed in claim 15 further comprising an anti-skid disk, said anti-skid disk affixed to said tensioning member, a resilient anti-skid plate, said anti-skid plate affixed to said first leg.

* * * * *